US005514022A

United States Patent [19]

Harris

[11] Patent Number: 5,514,022

[45] Date of Patent: May 7, 1996

[54] TOY BALLOON PACKAGING

[75] Inventor: Dale A. Harris, Chicago, Ill.

[73] Assignee: M & D Balloons, Inc., Manteno, Ill.

[21] Appl. No.: 333,600

[22] Filed: Nov. 2, 1994

Related U.S. Application Data

[63] Continuation of Ser. No. 41,755, Apr. 2, 1993, abandoned.

[51] Int. Cl.[6] ..... A63H 27/10; G09F 21/06

[52] U.S. Cl. ..... 446/75; 446/77; 446/220; 40/214

[58] Field of Search ..... 446/220, 225, 446/223, 75, 77, 221, 222, 71; 40/214, 212

[56] References Cited

U.S. PATENT DOCUMENTS

| | | | |
|---|---|---|---|
| 2,635,386 | 4/1953 | Guischard | 446/223 |
| 3,092,388 | 6/1963 | Wagenheim | 446/220 X |
| 4,305,501 | 12/1981 | Collette | 446/220 X |
| 4,307,537 | 12/1981 | Bergmann | 446/225 |
| 4,813,902 | 3/1989 | Messer | 446/71 |
| 4,857,029 | 8/1989 | Dierick et al. | 446/220 |
| 5,004,633 | 4/1991 | Lovik | 446/221 X |
| 5,009,624 | 4/1991 | Estam-Goggin | 446/71 |
| 5,035,391 | 7/1991 | Steele et al. | 446/220 X |
| 5,074,510 | 12/1991 | Metz | 248/176 |

FOREIGN PATENT DOCUMENTS

| | | | |
|---|---|---|---|
| 854768 | 7/1949 | Germany | 446/220 |

OTHER PUBLICATIONS

"Get a Handle on your Balloons . . . ," *Balloons and Parties Today,* Advertisement–Reader Response #33, p. 50, No date shown.

"Unique® Balloon Weights," *Balloons and Parties Today, Full page Advertisement–Reader Response #24, No date shown.*

Van Dyke et al, "Packaged Balloon and Greeting Card", CTI Industries Corp., Barrington, Il., Pub. Aug. 16, 1994, U.S. patent application Ser. No. 59,054.

Copies of the front and back panels of the "ONEPAC" product, and promotional flyer for the product, Marketer: M&D Balloons, Manteno, IL 60950 (copies in C1446/sub220).

*Primary Examiner*—Mickey Yu

*Attorney, Agent, or Firm*—Fitch, Even, Tabin & Flannery

[57] ABSTRACT

A balloon package is provided to facilitate erection of a balloon assembly, which prevents unintentional loss of buoyant balloons. The package includes an uninflated balloon, a placard or preferably planar object of a mass sufficient to overcome the buoyancy of the balloon when inflated and articles such as a ribbon for joining the balloon to the placard. In an alternative embodiment, the neck of the balloon is inserted directly into the placard. In package form the balloon kit is sealed in a plastic overwrap.

8 Claims, 3 Drawing Sheets

Fig. 1
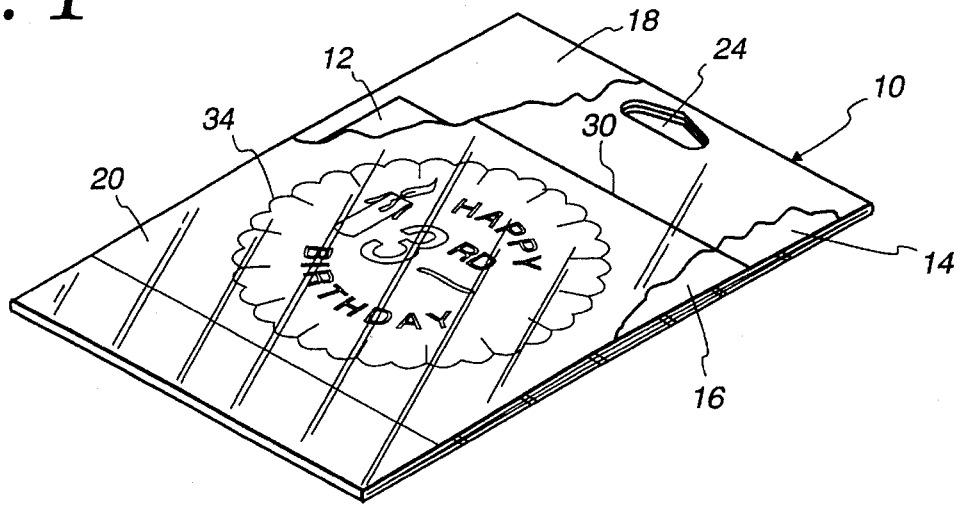
Fig. 4
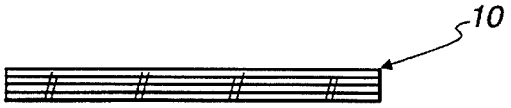
Fig. 2
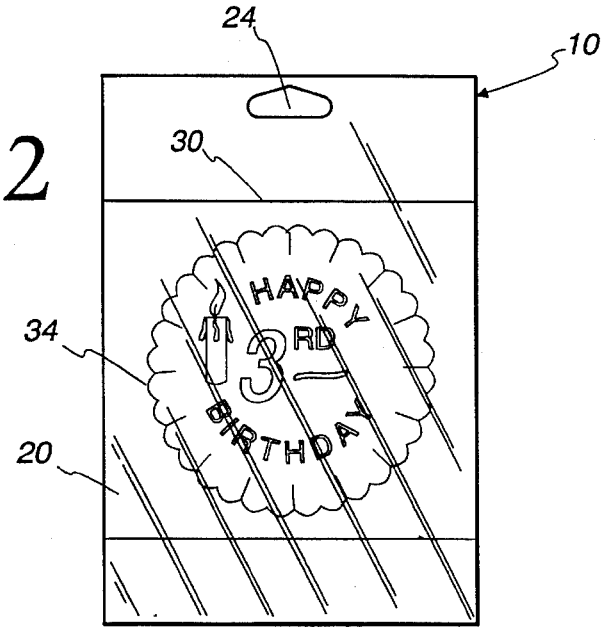
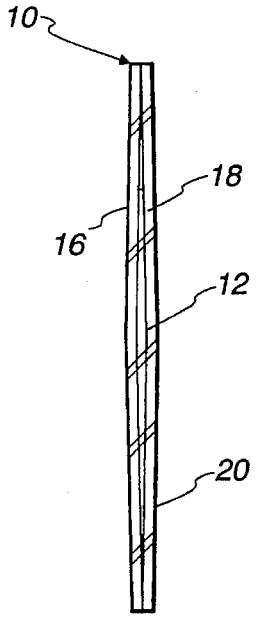
Fig. 3
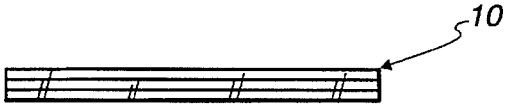
Fig. 5

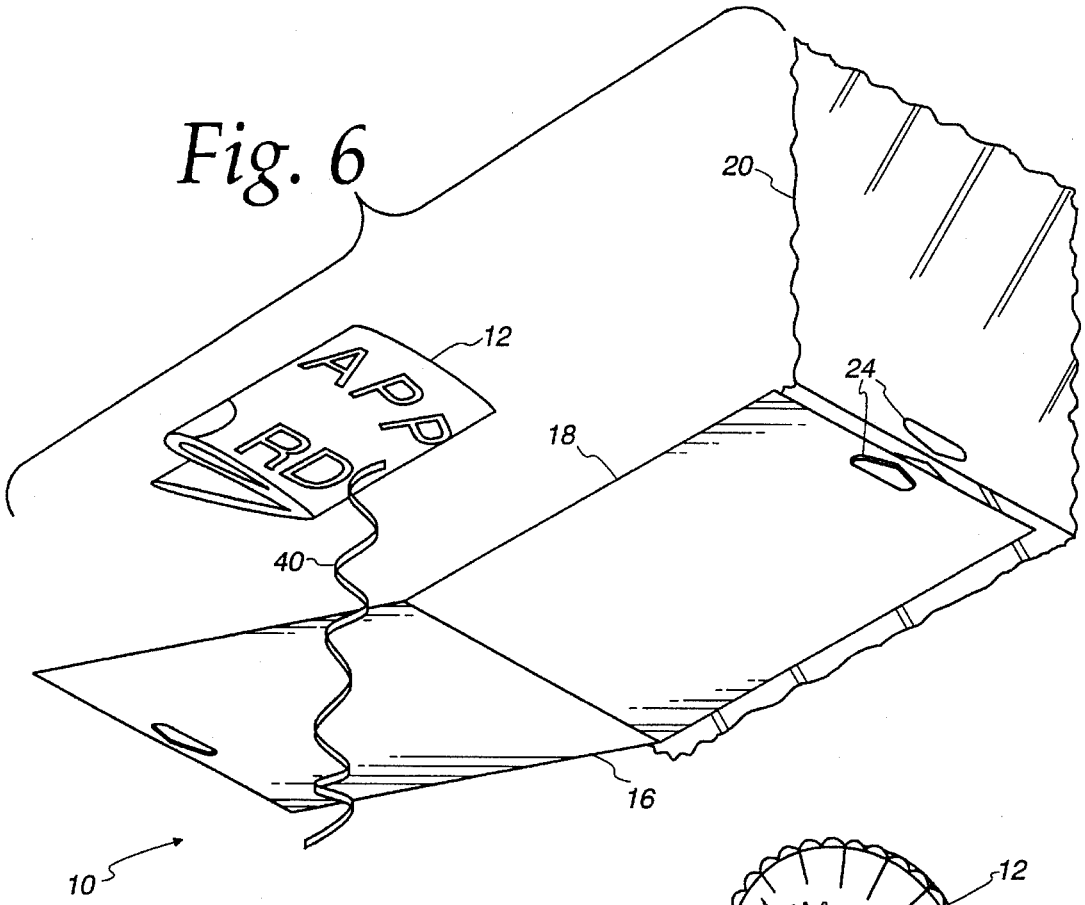
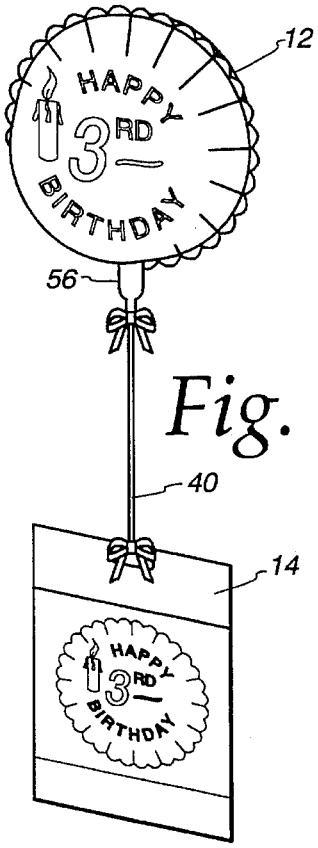
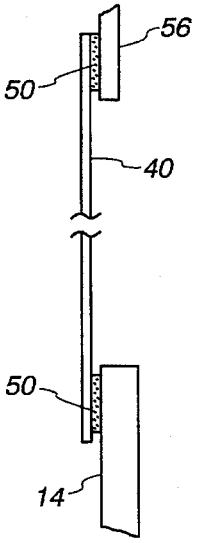
Fig. 9
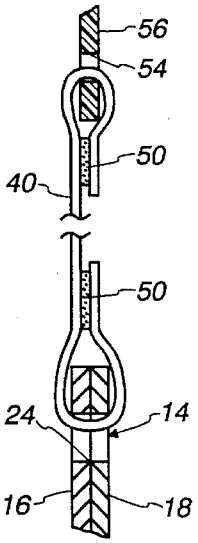
Fig. 8

TOY BALLOON PACKAGING

This application is a continuation, of application Ser. No. 08/041,755, filed Apr. 2, 1993, abandoned.

BACKGROUND OF THE INVENTION

1. Field of the Invention

The present invention pertains to packaging for toy balloons.

2. Description of the Related Art

Substantial numbers of toy balloons are purchased at public events, novelty shops, stores selling greeting cards and similar items and similar commercial enterprises. Typically, the toy balloons are one of a wide variety of products offered for sale in these establishments, and accordingly, there may be little or no opportunity for store personnel to become acquainted with the stockkeeping units and other identifying indicia provided by balloon manufacturers for the trade. There is an ever-increasing variety of toy balloon products. For example, toy balloons are typically imprinted with widely varying artwork, lettering and, on occasion, special legends. Further, toy balloons bearing the same artwork and lettering are offered in a number of different sizes.

Merchandise inventory and stockkeeping systems employed today typically use text or verbal description to identify the commercial product. While these systems have been immediately accepted for many different products, significant difficulties have been encountered in the field of toy balloon merchandising, where different artwork (e.g., fanciful illustrations of animals) may deal with a common theme for which verbal descriptions are at best confusing, and at worst are identical or otherwise nondistinguishing. For example, a verbal description such as "duck carrying Happy Birthday sign" may not be meaningful to store personnel who are only casually familiar with the toy balloons currently carried by the store. As a result, the toy balloons are usually taken out of stock and presented to a potential customer to identify the product in an effort to "close the sale." All but the smallest size balloons are shipped folded and are oftentimes inventoried in a store as a stack resembling a stack of folded sheets of film. For a customer who might want to examine several different balloon designs, the stack of folded balloons must be examined for duplicates, with balloons having the desired design, and the desired size, being extracted from the pile. Very often, this is laborious and time-consuming and improvements have been sought.

Toy balloons made of a metalized film are becoming increasingly popular. These types of balloons are often filled with a gas which is "lighter than air", with the result that the balloons, when released, tend to ascend at a rate such that the balloon quickly passes beyond a person's grasp. In an effort to accommodate users who may not be familiar with this phenomenon, sellers of toy balloons may tie a string or ribbon to the balloon as a convenient tether. Despite these precautions, a momentary lapse of attention can result in loss of the toy balloon. Accordingly, to date, weights have been manufactured and distributed separately from the toy balloons, for eventual use therewith. These weights are typically comprised of one or more layers of paperboard material shaped in the form of a rectangular tab of sufficient mass so as to counterbalance the buoyancy of the balloon. These weights are typically connected to the balloon by a ribbon or string tether.

SUMMARY OF THE INVENTION

It is an object according to principles of the present invention, to provide improved systems for controlling the buoyancy of lighter-than-air metalized balloons.

Another object according to principles of the present invention is to provide improved packaging for toy balloons which allows a seller to quickly identify the artwork imprinted on the balloon.

These and other objects according to principles of the present invention are provided in a package for a toy balloon, comprising:

a noninflated toy balloon to be inflated upon removal from the package so as to assume a preselected buoyancy;

a tab of sufficient weight to balance the buoyancy of the balloon;

an overwrap at least partly surrounding the toy balloon and the tab; and attachment means disposed within the overwrap, for attaching the toy balloon to the tab.

BRIEF DESCRIPTION OF THE DRAWINGS

FIG. 1 is a perspective view of a balloon package according to principles of the present invention;

FIG. 2 is a front elevational view thereof;

FIG. 3 is an elevational view from the right side thereof, the elevational view from the left side thereof being a mirror image;

FIG. 4 is a top plan view thereof;

FIG. 5 is a bottom plan view thereof;

FIG. 6 is an exploded perspective view thereof;

FIG. 7 is a perspective view of a completed balloon assembly;

FIGS. 8 and 9 show alternative arrangements for joining the components of the package together;

DETAILED DESCRIPTION OF THE PREFERRED EMBODIMENT

Figure 10:
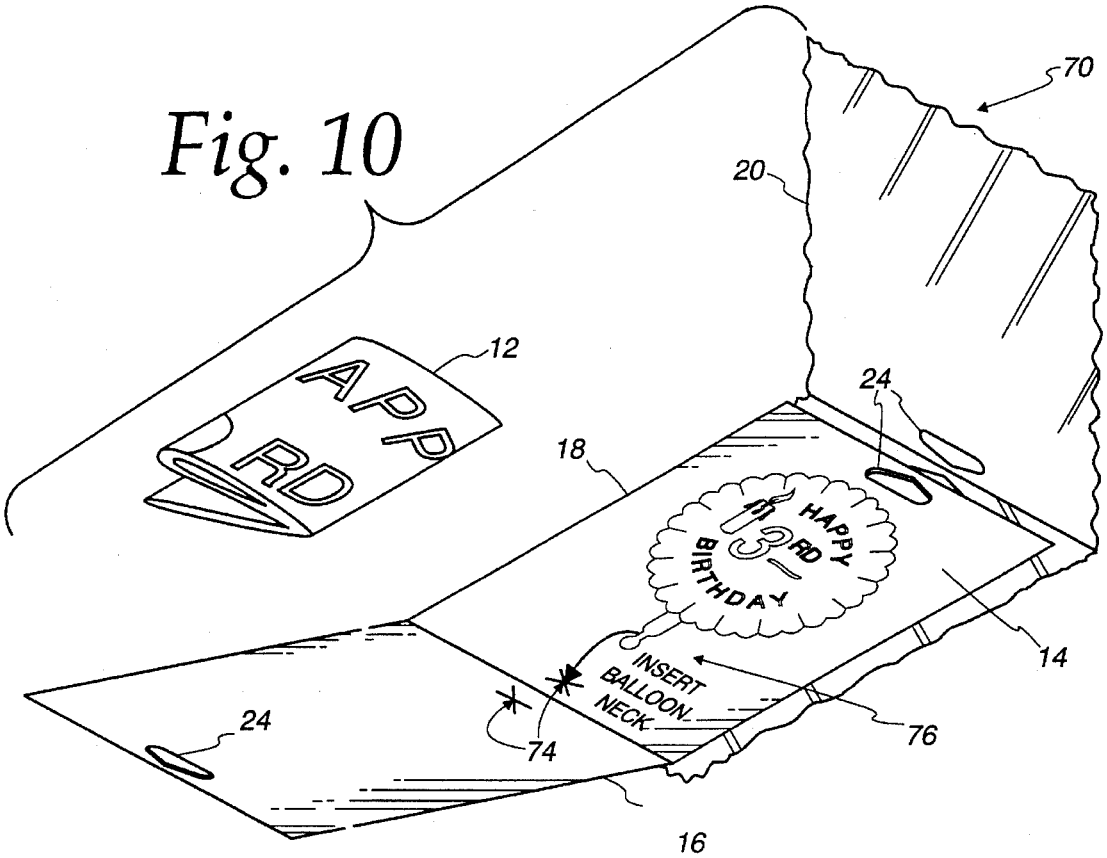
FIG. 10 is a perspective view of an alternative balloon package.

Referring now to the drawings, and in particular to FIG. 1, a package for a toy balloon is generally indicated at 10. The package includes a toy balloon 12 in a noninflated, folded condition, disposed within a paperboard placard 14, preferably of monolithic construction, folded at the bottom end to form overlapping layers 16, 18. Surrounding the placard is a plastic overwrap 20, preferably of transparent plastic film.

In the preferred embodiment, a generally triangular aperture 24 extends through the plastic overwrap 20 and placard 14 for receiving the hook of a display device. In the preferred embodiment, the placard 14 is generally coextensive with the major surfaces of package 10. The placard 14 provides strength for the package, to allow the package to hang, resisting localized tearing forces adjacent the aperture 24. If desired, the placard 14 could be shortened, so as to provide localized support adjacent the aperture 24. For example, the placard 14 could be truncated along the linear design element or line 30 with the bottom portion of the placard, below design line 30, being omitted. This would provide localized strength or reinforcement adjacent the aperture 24 and would provide the package strength necessary to hang package 10 from a display hook.

However, placard 14 is preferably of a substantially larger size so as to include photographic or other artwork indicia 34 showing the balloon in its inflated condition, or at least showing the artwork on a major face of the balloon. As mentioned, the placard 14 has two overlapping layers 16, 18. The indicia 34 is printed on the upper layer 16 and faces in a forward direction. If artwork is applied to both external major surfaces of the balloon, similar indicia could be provided on layer 18 of placard 14, facing in an opposed, downward direction, the package thus providing an indication of the artwork on both opposing major surfaces of the balloon. In the preferred embodiment, the balloon 12, when unfolded, has major surfaces several times the area of the major surface of package 10. Thus, even if the outer fold of the balloon were observed, a pattern of the balloon still might not be recognizable from the small sampled area. With photographic, line drawing or other artwork techniques, the representation 34 of the inflated balloon can quickly provide identification of the balloon artwork for store personnel, even for complex artwork subject matter.

In addition to providing a literal indication of the balloon artwork, the placard 14 can provide a category reference of the kind usually associated with greeting cards (e.g., "anniversary", "birthday" and "congratulations"). Bar code labeling can also be applied to the placard 14, along with other stockkeeping information.

Further significant advantages are possible with the present invention. For example, the balloon package can now be displayed along with other products, accessible to potential purchasers for their personal inspection as an aid in making a purchasing decision. Thus, the balloon package can "sell itself", without requiring a shopkeeper's attention, which can be devoted for other tasks.

Additional advantages are also possible with the present invention. For example, verbal or graphic instructions for assembling the contents of the package can be prominently displayed on the reverse side of the placard 14. For balloons which are to be filled with a gas lighter than air, the consumer and store personnel can be educated as to the proper assembly of the package contents in order to prevent loss of the buoyant balloon. With the present invention, instructions can be given to the salesperson inflating the balloon so that the balloon is immediately adapted for secure retention at the time of its inflation. Further, apart from the instructions which may be placed on placard, a salesperson is prompted to complete the assembly by reason of the presentation of the component parts when the overwrap is opened. For example, referring to FIG. 6, the balloon package 10 further includes a ribbon 40 to be tied between the balloon and the placard 14. The placard 14 can include instructions for the completed balloon assembly shown in FIG. 7 and can even contain a photograph or drawing showing the completed balloon assembly. Referring to FIG. 7, the ribbon 40 is tied at its opposed ends to balloon 12 and placard 14. If desired, the connection of ribbon 40 to the placard 14 can be done prior to packaging in the overwrap 20 and can, for example, be incorporated into an overall design and printed on placard 14.

Referring now to FIGS. 8 and 9, the ribbon 40 can be provided with an adhesive coating 50. As shown in FIG. 8, the upper end of ribbon 40 is looped through an aperture 54 formed in the neck 56 of balloon 12. The upper end of ribbon 40 is doubled over, with the adhesive coating 50 securing the free end of the ribbon to a mid-portion of the ribbon to form a closed loop. The bottom end of ribbon 40 is, in a similar manner, threaded through aperture 24 in placard 14, being doubled over and secured to a mid-portion of ribbon 40 by a second adhesive coating 50. As shown in the alternative embodiment of FIG. 9, the upper end of ribbon 40 is secured to neck 56 with the adhesive portion 50. If desired, the adhesive joinder can be replaced with a heat-sealed joinder, with ribbon 40 or coating 50 made from a heat-sealable material. The bottom end of ribbon 40 is secured to a surface of placard 14 with a second adhesive portion 50. If desired, the bottom portion of ribbon 40 can also be secured to placard 14 with heat sealing or other joining methods. It is generally preferred, however, that the adhesive coating 50 be applied to the free ends of ribbon 40 at the time of ribbon manufacture, and be temporarily covered in a conventional fashion, with a sheet of release material which can be peeled away to expose the adhesive portions.

Figure 13:
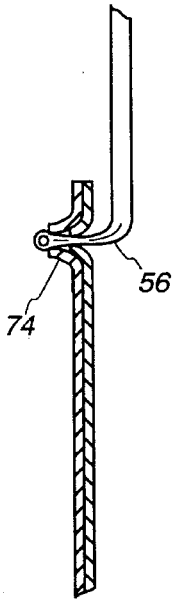
FIG. 13 is a fragmentary cross-sectional view of FIG. 12.
Figure 12:
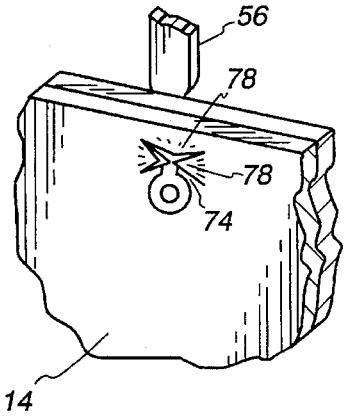
FIG. 12 is a fragmentary perspective view showing the portion of FIG. 11 on an enlarged scale.
Figure 11:
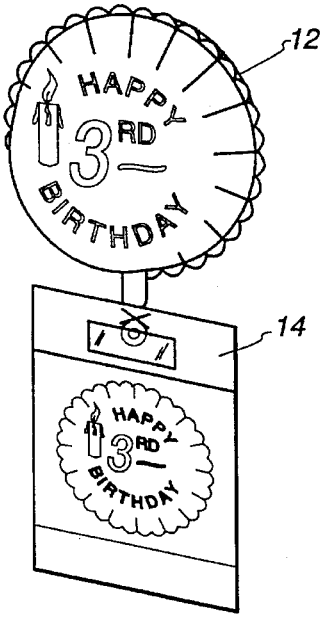
FIG. 11 is a perspective view of a completed balloon assembly constructed from the package.

Referring now to FIG. 10, an alternative embodiment of a balloon package is generally indicated at 70. The balloon package includes balloon 12, placard 14 and an overwrap 20. The placard 14 is preferably made of paper material, such as paperboard or cardboard, as in the preceding embodiment, and the overwrap 20 is preferably made of transparent plastic material. In this embodiment, a ribbon is not provided; rather, the balloon neck is inserted directly through the placard 14. In the embodiment shown in FIGS. 10–12, the placard 14 has the same configuration as described above, with overlapping layers 16, 18 in apertures 24 for receiving a display hook. However, in the embodiment shown in FIG. 10, additional features are added, including X-shaped slits 74 and further assembly instructions 76 printed on the inside or hidden surfaces of the placard. Referring to FIGS. 12 and 13, the balloon neck is inserted through the X-shaped slits 74 creating a plurality of retention barbs 78 which engage the balloon neck, preventing its retraction from placard 14, thus ensuring a secure engagement with the balloon.

Various alternative constructions are contemplated by the present invention. For example, the placard 14 may be constructed of materials other than paper products. For example, the placard 14 may be made of plastic materials and, in keeping with the balloon message, may be made of plastic molded articles of appropriate shape. For example, the legend on the illustrated balloon 12 may be complemented with a plastic numeral "3" of sufficient weight to counteract the buoyancy of the balloon. The X-shaped slits may be provided in the plastic numeral or a ribbon may be provided, as illustrated above, to secure the plastic numeral to the balloon. The plastic article could also comprise a medallion bearing an appropriate message, which would add to the visual impact of the complete balloon assembly.

The placard 14 can be replaced with a weighting member that need not be rectangular or flat or stiff, although such is preferred.

Also, further variations relating to merchandising techniques are also possible. For example, the balloon 12 has been shown in an individual wrapping, with a transparent plastic overwrap. If desired, the contents contained within the overwraps described above can be shipped without the overwrap, in kit form, the kit contents usually being assembled by the personnel inflating the balloon included as part of the kit. For example, multiple balloon kits can be shipped to a store in an expanding plastic wallet, much like the plastic windows inserted in leather wallets in common use today. In this manner, balloon kits can be shipped to the store in bulk form. Of course, several balloon kits can be assembled in a common overwrap if desired.

With the present invention, balloon packages or balloon kits can now be associated with other types of commercial articles. For example, balloon packages or balloon kits can be associated with stuffed animals, with the balloon kits or contents of the balloon packages being assembled at the time the stuffed animal is sold, to provide a finished commercial article comprising the combination of stuffed animal and balloon assembly. In any event, as can now be seen with the present invention, buoyant metalized and plastic balloons can now be secured to an attractive (and optionally, instructive) weight, to prevent the unintentional escape of the balloon.

With placards having a generally planar surface, a purchaser of a balloon assembly can easily apply an adhesive label or sticker to the placard to complete the balloon product. For example, balloon kits or balloon packages can be purchased in quantity, for use in a particular social event. A user can bring adhesive labels to the site where the balloons are inflated, and can apply individual, customized, and perhaps proprietary labels to the balloon placards to further customize and enhance the presentation of the finished balloon to its intended recipient (such as employees or customers of the purchaser, for example).

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A marketing display kit for a toy balloon, the kit comprising:

a package comprising a pocket and a tab which forms at least a part of the package, the tab having an aperture adapted for hanging the package for the display thereof;

a noninflated toy balloon with a preselected volume to be inflated with a lighter than air gas upon removal from the package so as to assume a preselected buoyancy, the balloon having a surface with artwork which is displayed when the balloon is inflated; and an elongated flexible restraint line contained in the package for attaching the toy balloon to the tab through the aperture in the tab, the lower end of the line being attached to the tab, the upper end of the line being attached to the balloon when it is inflated, the tab having sufficient weight to balance the buoyancy of the balloon when the balloon is in an inflated condition to the preselected volume with the lighter than air gas to the preselected buoyancy, the package having artwork indicative of the artwork on the surface of the balloon to illustrate the balloon in an inflated condition.

2. The marketing display kit as recited in claim 1 wherein said restraint line is double-ended and at least one of said ends includes an adhesive coating for adhesive attachment.

3. The marketing display kit as recited in claim 1 wherein said package further comprises an overwrap, wherein the overwrap comprises a plastic bag having an opening at one end, and the aperture in the package aligned with the opening.

4. The marketing display kit as recited in claim 3 wherein the balloon is a metallized balloon.

5. The marketing display kit of claim 1 wherein said tab comprises a sheet of paper material folded to form two overlying portions which form a pocket to contain the restraint line and uninflated balloon.

6. The marketing display kit as recited in claim 1 wherein the balloon is a metallized balloon.

7. A method for providing a counterweight for a metallized balloon, the method comprising;

packaging a noninflated metallized balloon to provide a balloon package the noninflated balloon adapted to be inflated with a lighter than air gas to a preselected buoyancy upon removal of the balloon from the package;

inflating the balloon with a lighter than air gas to a preselected buoyancy; and attaching at least part of the package to the metallized balloon, the package attached to the balloon having a predetermined weight sufficient to counterweight the metallized balloon when the balloon is inflated with a lighter than air gas.

8. A method as recited in claim 7 wherein the package includes an elongated restraint line, the method further comprising attaching the line to the balloon and package to attach the balloon to the package.

* * * * *